US006044520A

United States Patent [19]

Yamamoto

[11] Patent Number: 6,044,520

[45] Date of Patent: Apr. 4, 2000

[54] VACUUM CLEANER

[75] Inventor: Masafumi Yamamoto, Kurita-gun, Japan

[73] Assignee: Matsushita Electrical Industrial Co., Ltd., Osaka, Japan

[21] Appl. No.: 09/069,251

[22] Filed: Apr. 29, 1998

[30] Foreign Application Priority Data

Jun. 11, 1997 [JP] Japan ..... 9-153350

[51] Int. Cl.[7] ..... A47L 9/00

[52] U.S. Cl. ..... 15/390; 15/351

[58] Field of Search ..... 15/351, 389, 390, 15/410, 412

[56] References Cited

U.S. PATENT DOCUMENTS

| | | | |
|---|---|---|---|
| 1,978,526 | 10/1934 | Eppler | 15/390 |
| 2,601,698 | 7/1952 | Humphrey | 15/390 |
| 4,446,594 | 5/1984 | Watannabe et al. | 15/323 |
| 4,446,595 | 5/1984 | Nakada et al. . | |
| 4,637,092 | 1/1987 | Hayashi et al. | 15/390 |
| 4,686,736 | 8/1987 | Petralia et al. | 15/390 |
| 4,748,714 | 6/1988 | Tschudy . | |
| 5,331,716 | 7/1994 | Hemmann et al. | 15/390 |
| 5,768,746 | 6/1998 | Kamatani et al. | 15/390 |
| 5,839,160 | 11/1998 | Wang et al. | 15/390 |

FOREIGN PATENT DOCUMENTS

| | | |
|---|---|---|
| 06154134 | 3/1994 | Japan . |
| 2271275 | 4/1994 | United Kingdom . |

*Primary Examiner*—Terrence R. Till
*Attorney, Agent, or Firm*—McDermott, Will & Emery

[57] ABSTRACT

A vacuum cleaner comprises a floor nozzle housing an agitator for stirring dust, a handle sector containing a dust bag and a fan motor for sucking dust, and a power transmission device for transmitting the driving force of the fan motor to the agitator. The handle sector is tiltably attached to the floor nozzle at a rear section. The power transmission device comprises a driving pulley fixed to the agitator, an idling pulley attached adjacent to the driving pulley and rotating free from the agitator, and a belt provided between the fan motor and one of the driving pulley and the idling pulley. A switching lever is provided for switching the position of the belt to the driving pulley or to the idling pulley, which motion is coupled with the tilting motion of the handle sector. The driving force of the fan motor is conveyed to the agitator in accordance with the tilting motion of the handle sector.

23 Claims, 14 Drawing Sheets

VACUUM CLEANER

BACKGROUND OF THE INVENTION

The present invention relates to a vacuum cleaner comprising a floor nozzle and a handle sector attached tiltable to the floor nozzle.

A typical structure of conventional vacuum cleaners of the above type is shown in FIG. 15. The structure is described in the following. As illustrated in FIG. 15, a floor nozzle 1 houses an agitator 2, and a handle sector 3 is tiltably attached to the floor nozzle 1. The handle sector 3 contains a fan motor (not shown) for sucking dust stirred by floor nozzle 1 into a dust bag (not shown), and a motor shaft of the fan motor is coupled to the agitator 2 for rotating the agitator 2. A pedal 5 is provided at a lower rear section of floor nozzle 1 for unlocking the tilting status of the handle sector 3 with respect to the floor nozzle 1. A switch 6 is provided at an upper rear section of floor nozzle 1 for starting/halting the rotating of the agitator 2. The switch 6 may be either a foot operating type or hand operating type.

A hand operating type switch 6 may have a lower cost, but commonly requires a operator to effect the unpleasant action of bending his her/back so that his/her finger can reach the switch 6 disposed at the top part of floor nozzle 1 for the switching operation. A foot operating type switch 6 may be more operator-friendly in that it does not require the bending action, but it requires complex parts and structure, therefore the manufacturing cost may be higher.

The switch 6 is a device that functions independently from the pedal 5 which is provided for unlocking the handle sector 3. Therefore, when starting to clean a carpet, an operator first has to press the pedal 5 of floor nozzle 1 down to unlock the handle sector 3, and then operate the switch 6 to start rotation of agitator 2. Namely, two actions, viz. pressing the pedal down and operating the switch, are required before starting a normal cleaning operation. Likewise, when changing from carpet cleaning to another kind of cleaning work which requires an attachment, rotation of the agitator 2 has to be halted from time to time. Thus, troublesome operational steps are required with conventional vacuum cleaners.

There may be operators who do not always turn off the rotation of agitator 2 when cleaning chores are finished, or when an attachment is being used. In the former case, when the power switch is turned on for the next cleaning operation, the agitator 2 abruptly starts rotating, and clothes or other items left near the agitator might be wound around the rotating agitator. Similarly, in the latter case, casual cloth fragments, etc., on the floor might be entangled in the agitator. During cleaning work, it is not easy for an operator to see whether agitator 2 is rotating or not, as the agitator 2 is disposed in a place which is concealed from the operator. While some cleaners have an indicator provided near the switch 6, such indication is by stamping, or the like, on the body and is not clear enough for a standing operator.

SUMMARY OF THE INVENTION

An object of the invention is to provide a vacuum cleaner having advantages in handling convenience. The vacuum cleaner has a handle sector tiltably attached to a floor nozzle on a pivot and a single action of moving the handle sector starts/stops rotation of an agitator. When the handle sector is held upright, the agitator automatically halts its rotation. Thus, problems resulting from needlessly rotating the agitator or other inconveniences may be prevented.

The vacuum cleaner comprises a floor nozzle housing an agitator for stirring dust, a handle sector tiltably attached to the floor nozzle on a pivot in a rear section which contains a fan motor for sucking the stirred dust and a dust bag for collecting the sucked dust, and power transmitting means for transmitting a driving force of the fan motor to the agitator. The driving force of the fan motor is conveyed through a power transmitting means to the agitator in accordance with the tilt status of the handle sector.

In the above arrangement, the agitator is put into rotation only when the handle sector is tilted with respect to the floor nozzle. This means that an operator can start/stop rotation of the agitator by a single action of tilting the handle sector.

It is preferred to provide on a roof section of the floor nozzle a kind of pop-up button that is engaged with movement of a pedal which unlocks the handle sector so that an operator can readily recognize that the agitator is revolving by the popped-up button.

DESCRIPTION OF THE PREFERRED EMBODIMENTS

A first exemplary embodiment of the present invention is described in the following with reference to the drawings.

Figure 1:
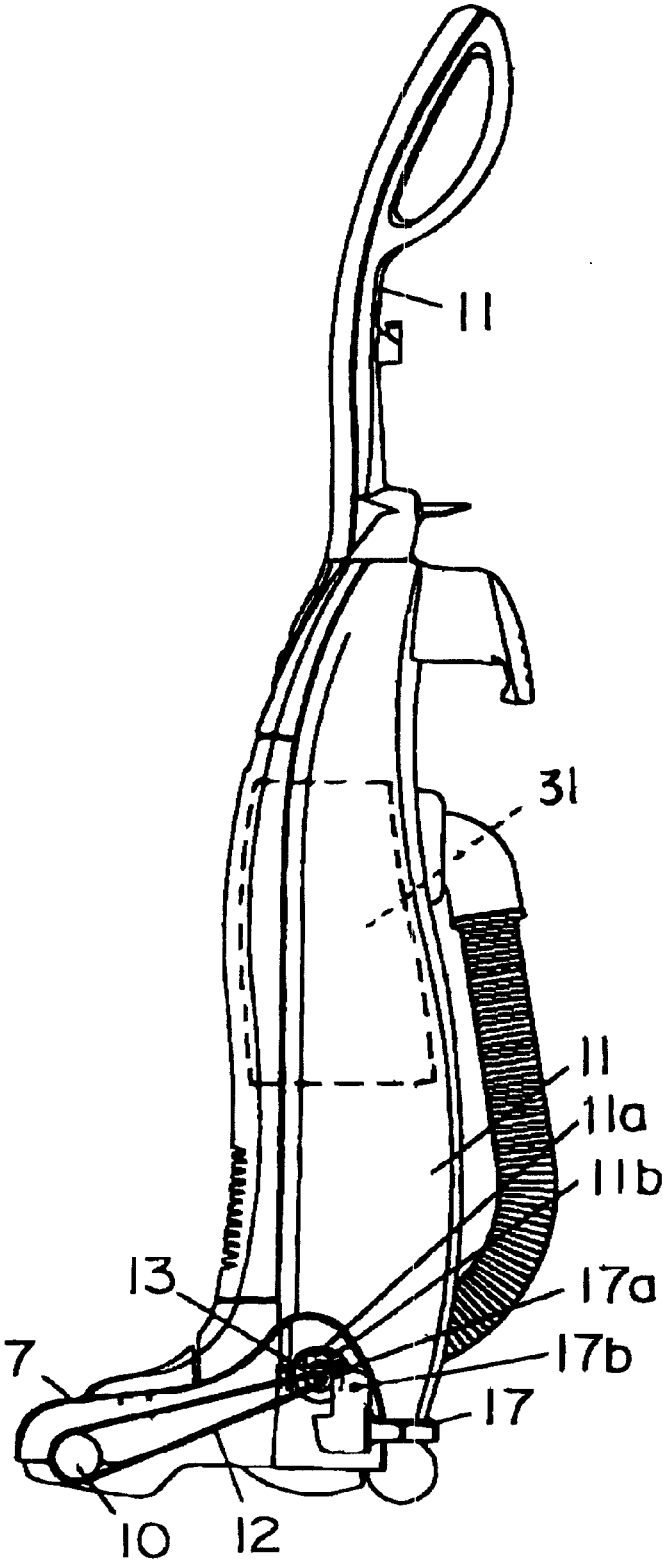
FIG. 1 is a partially-cutaway side view of a vacuum cleaner in accordance with a first exemplary embodiment of the invention.
Figure 2:
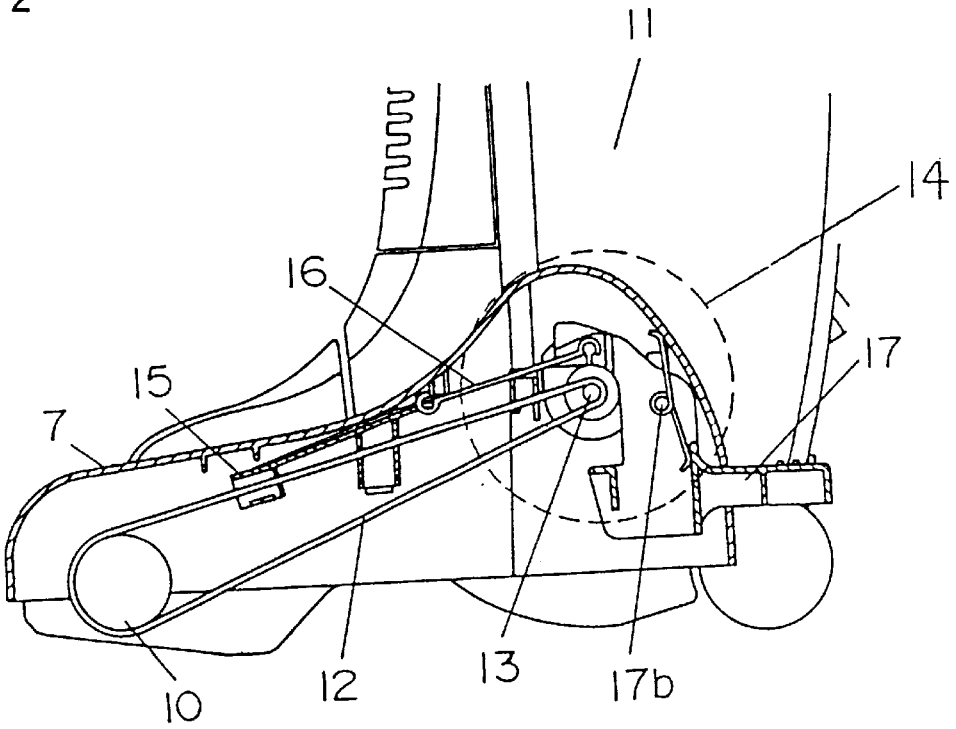
FIG. 2 is a vertical cross-sectional view showing a floor nozzle of the vacuum cleaner of FIG. 1.
Figure 3:
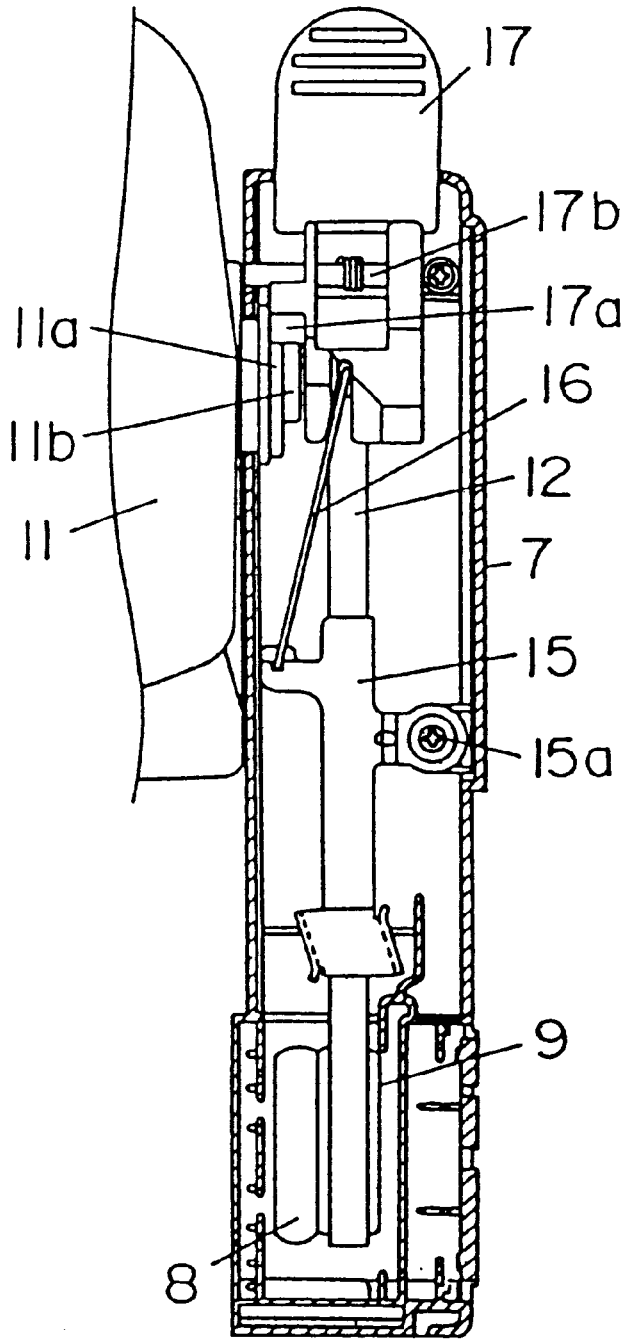
FIG. 3 is a horizontal cross-sectional view showing a floor nozzle of the vacuum cleaner of FIG. 1.

As shown in FIG. 1 through FIG. 3, a floor nozzle 7 houses an agitator 10 for stirring dust and comprises a driving pulley 8 and an idling pulley 9 disposed in a row. The driving pulley 8 is fixed to the agitator 10 while the idling pulley 9 is disposed besides the driving pulley 8 and is left free from the rotation of agitator 10. A handle sector 11 is tiltably attached to the floor nozzle 7 on a pivot at a rear section, and houses a fan motor 14 for sucking dust stirred by the floor nozzle 7 into a dust bag (not shown). A motor shaft 13 of the fan motor 14 is engaged to either the driving pulley 8 for agitator 10, or the idling pulley 9, by a belt 12 forming a power transmission device for conveying the driving force of fan motor 14 to agitator 10. The power transmission device conveys the driving force to agitator 10 in accordance with tilt state of the handle sector 11. When the handle sector 11 is in an almost upright state, the rotation of agitator 10 is brought to a halt.

Inside the floor nozzle 7, a switching lever 15 is provided rotatable around an axle 15*a*, for switching the belt 12 from the driving pulley 8 to the idling pulley 9, or vice versa. The switching lever 15 is engaged via a connecting lever 16 with a pedal 17 provided at a rear section of the floor nozzle 7. Through the above mechanism, switching lever 15 is manipulated from outside the floor nozzle by pressing the pedal 17 down.

Figure 4:
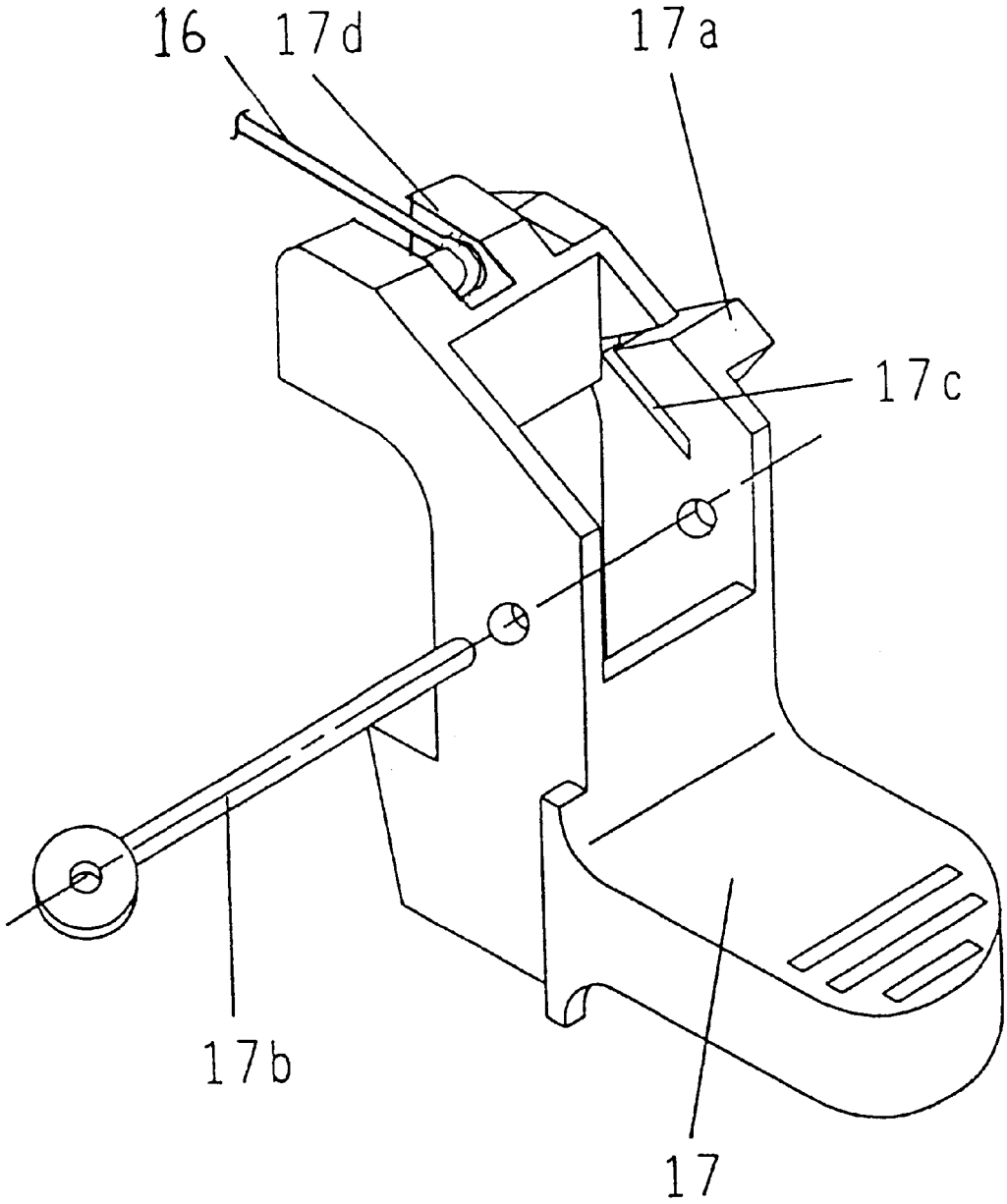
FIG. 4 is an enlarged perspective view of a pedal of the vacuum cleaner of FIG. 1.
Figure 5:
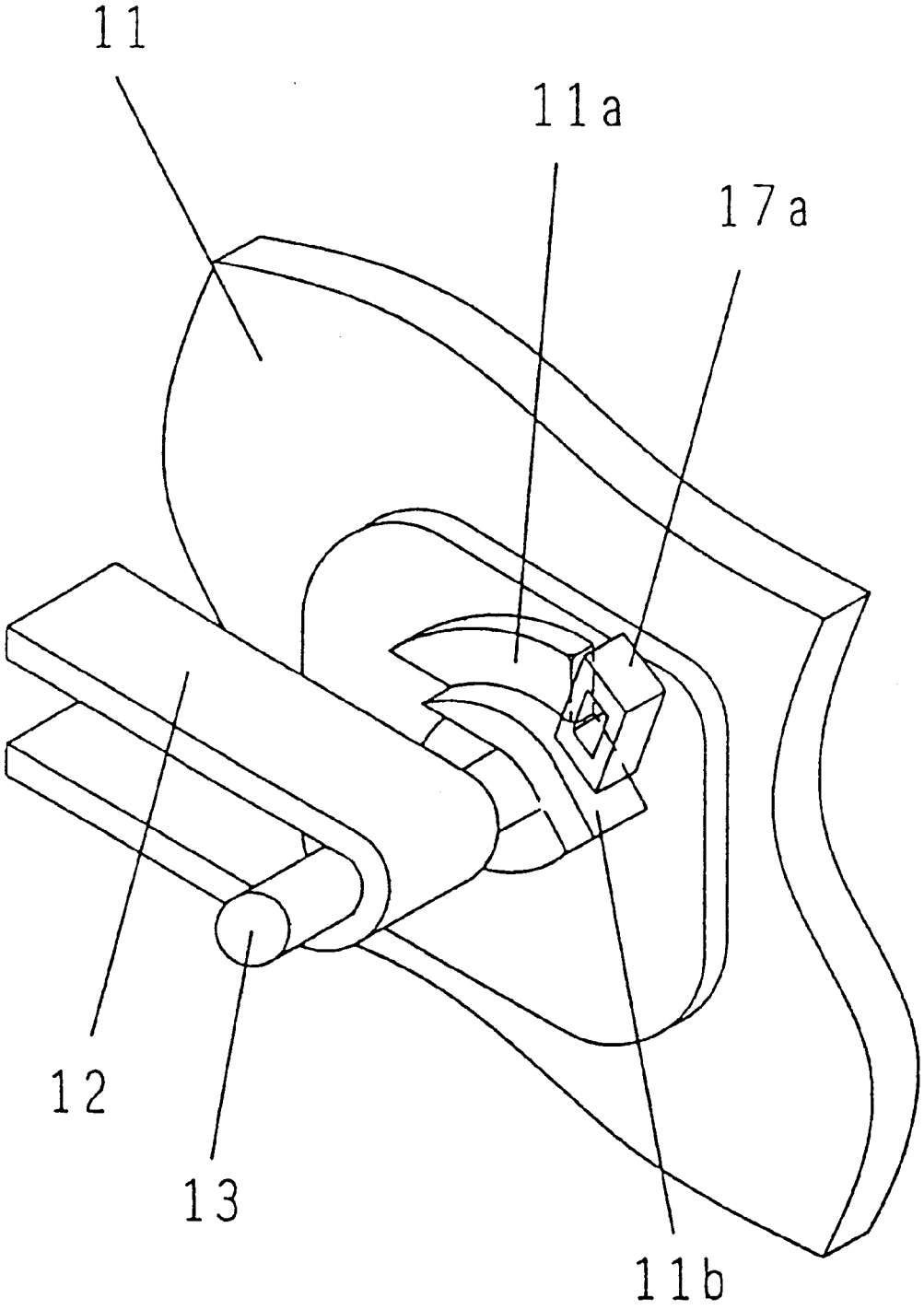
FIG. 5 is an enlarged perspective view of a key portion of the vacuum cleaner of FIG. 1.

The pedal 17 is rotatably attached with a pin 17*b* and has a protrusion 17*a* at a side and a cut 17*c* for providing a spring property to the protrusion 17*a*, as shown in FIG. 4. The connecting lever 16 is connected to an end of the pedal 17. As shown in FIG. 5, at a side of handle sector 11 is a cam 11*a* of circular arc shape, and a stage 11*b* of circular arc shape having a width broader than the cam 11*a* and a smaller radius at a place just beneath the cam 11*a*. When the handle sector 11 is in an upright position, the protrusion 17*a* provided at the side of pedal 17 is positioned on the stage 11*b*. When pedal 17 is pressed down and the handle sector 11 is tilted, the protrusion 17*a* rides on the outer circumferential surface of cam 11*a* whose size is bigger than the stage 11*b*, and the pedal 17 stays as it is in an inclined position. Thus the pedal 17 holds/releases positioning of the handle sector 11 relative to floor nozzle 7.

The operation of the above arrangement is described in the following. While the handle sector 11 is held almost upright to floor nozzle 7, the protrusion 17*a* of pedal 17 stays firmly at the foot of cam 11*a* provided at the side of handle sector 11, as illustrated in FIG. 5 or in FIG. 6 with solid lines, and the handle sector 11 and the floor nozzle 7 are fixed at an almost right angle to one another. Under such a state, the agitator 10 is kept from rotating even if fan motor 14 is turned on because the pedal 17 is not pressed down and, as a result, the switching lever 15 is not pulled by connecting lever 16 and the belt 12 is kept on the idling pulley 9, as shown in FIG. 3, i.e., the driving force of fan motor 14 is not transmitted to the agitator 10.

Figure 6:
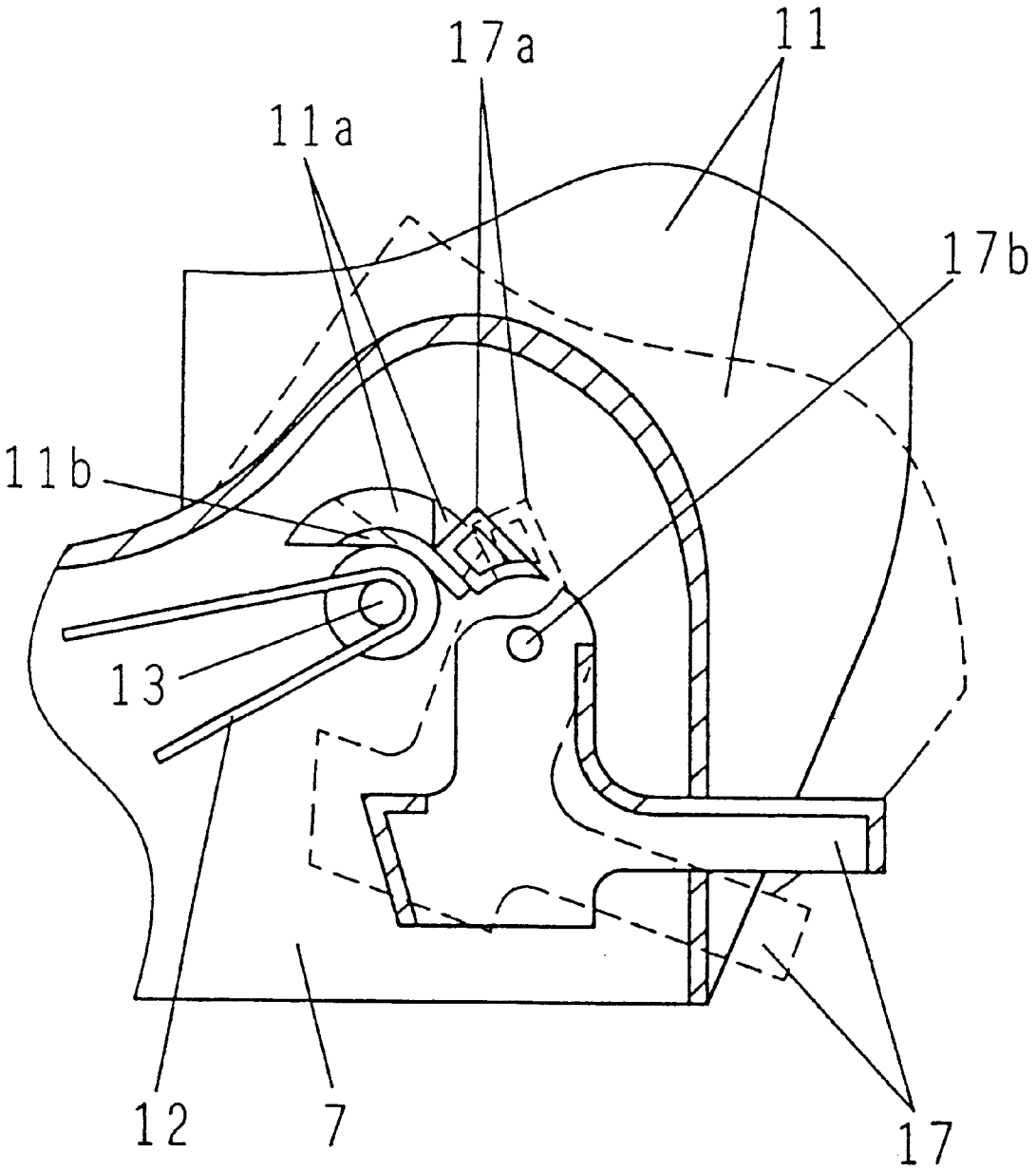
FIG. 6 is an enlarged cross-sectional view of a key portion showing an operating state of the vacuum cleaner of FIG. 1.
Figure 7:
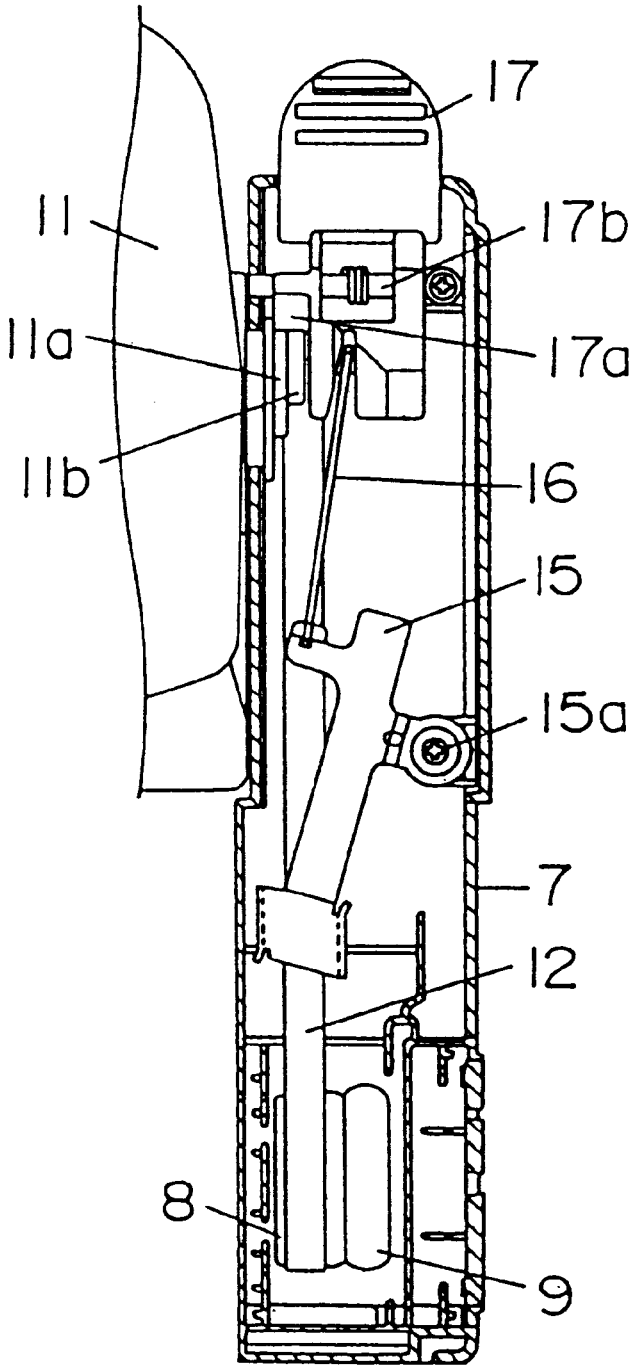
FIG. 7 is a horizontal cross-sectional view of a floor nozzle of the vacuum cleaner showing a state when the pedal is pressed down.

Then, when the pedal 17 is pressed down, it rotates around the pin 17*b* to a state as indicated with dotted lines in FIG. 6. When the handle sector 11 is tilted, the protrusion 17*a* of pedal 17 rides on cam 11*a* provided at the side of handle sector 11 and slides over the upper surface. The handle sector 11 is thus allowed to tilt with respect to floor nozzle 7 and is held fixed by the protrusion 17*a* riding over the outer circumferential surface of cam 11*a*. The connecting lever 16, connected at an end of pedal 17, is pulled as the pedal 17 rotates around the pin 17*b*. As a result, the switching lever 15 is pulled by the connecting lever 16 and rotates around the axle 15*a*, as shown in FIG. 7, to shift the belt 12 from over idling pulley 9 to driving pulley 8 of agitator 10. The driving force of fan motor 14 is thus conveyed to agitator 10 and the agitator 10 starts rotating.

By a single action of pressing pedal 17 down, the handle sector 11 is released for tilting and at the same time, the agitator 10 is set for rotation via switching lever 15. Thus, the rotation of agitator 10, via the driving force of fan motor 14, may be controlled on and off by a single action of pressing down the pedal 17 and tilting the handle sector 11. The dust stirred by agitator 10 is sucked by the sucking force of fan motor 14 into the handle sector 11. Thus, ease of handling a vacuum cleaner is increased.

Next, when the handle sector 11 is restored to the upright position, the protrusion 17*a* of pedal 17 comes down onto the stage 11*b* from the outer circumferential surface of cam 11*a* of handle sector 11, and the pedal 17 returns to the initial state. The switching lever 15, engaged with pedal 17, also returns to the initial position, the belt 12 is shifted from driving pulley 8 to idling pulley 9, the transmission of the driving force of fan motor 14 to agitator is disconnected, and the rotating of agitator 10 automatically halts. In this way, whenever the rotation of agitator 10 is not needed, e.g., when connecting an attachment, the agitator 10 is brought to a halt without fail. Thus, a problem of the agitator damaging a carpet while an attachment is being used may be eliminated.

Now in the following, a second exemplary embodiment of the present invention is described with reference to the drawings.

Figure 8:
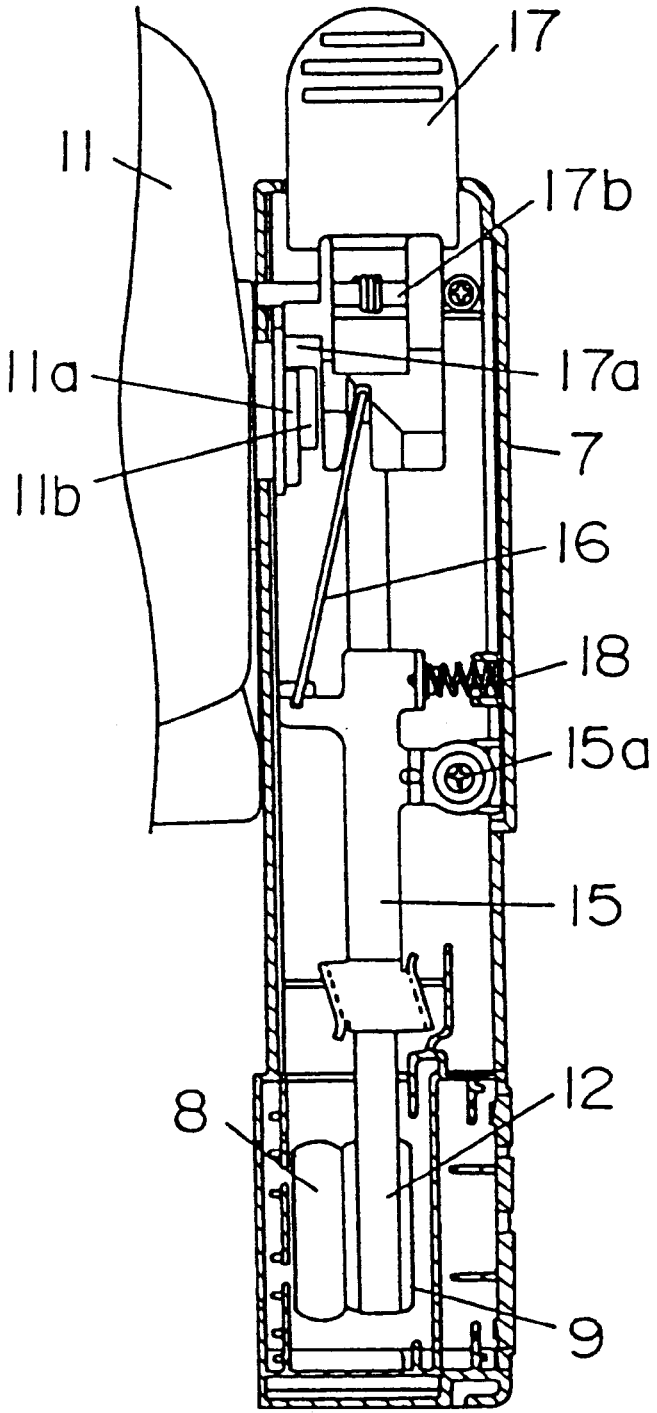
FIG. 8 is a horizontal cross-sectional view showing a floor nozzle in accordance with a second exemplary embodiment of the invention.

As shown in FIG. 8, a switching lever 15 is provided rotatable around an axle 15*a* and is given tension by a spring 18 so that a belt 12 is always guided to an idling pulley 9. The rest of the structures remain the same as those of the first embodiment.

Operation of the above structure is described in the following. Similar to the first embodiment, a press of pedal 17 allows the handle sector 11 to tilt with respect to floor nozzle 7, switching lever 15 rotates around axle 15*a*, and belt 12, positioned over the idling pulley 9, is shifted towards driving pulley 8 to rotate agitator 10.

Then, when the handle sector 11 is returned to the upright position, a protrusion 17*a* of pedal 17 comes down onto stage 11*b* from the outer circumferential surface of cam 11*a* provided on a side of the handle sector 11, and the pedal 17 returns to the initial state. As a result, the switching lever 15 engaged with pedal 17, rotates to the initial position, shifting the belt 12 from driving pulley 8 to idling pulley 9. The spring force of spring 18, provided for the switching lever, functions to ensure the shifting of belt 12 to idling pulley 9. Thus, a possible case of the belt 12 remaining in a position somewhere in between the driving pulley 8 and the idling pulley 9 may be prevented. If the belt 12 remains in such a position, the agitator 10 keeps on rotating, inviting a problem such as damaging a carpet.

A third exemplary embodiment of the present invention is described in the following with reference to the drawings.

Figure 9:
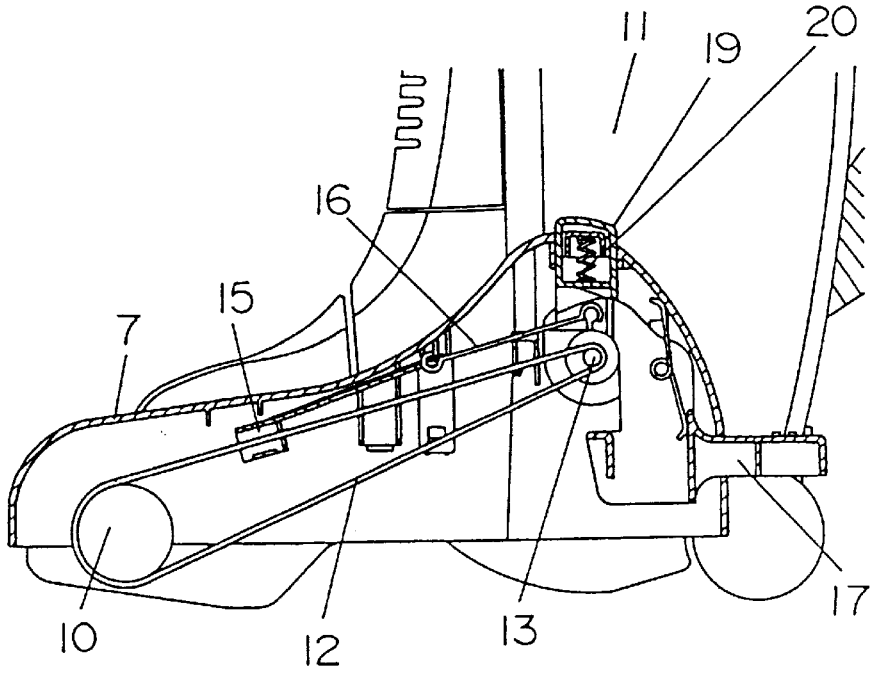
FIG. 9 is a vertical cross-sectional view showing a floor nozzle in accordance with a third exemplary embodiment of the invention.

As shown in FIG. 9, a button 19 is provided so that it can pop out and down freely through a hole located at a top section of floor nozzle 7, and is engaged with motion of a pedal 17. A button spring 20 is provided to always provide a downward bias to the button 19. Pushing down of once-popped-out button 19 brings the pedal 17 back to a position at which the tilt of handle sector 11 with respect to floor nozzle 17 is fixed, or the initial state. Other sections of the structures remain the same as those of the first or the second embodiment.

Figure 10:
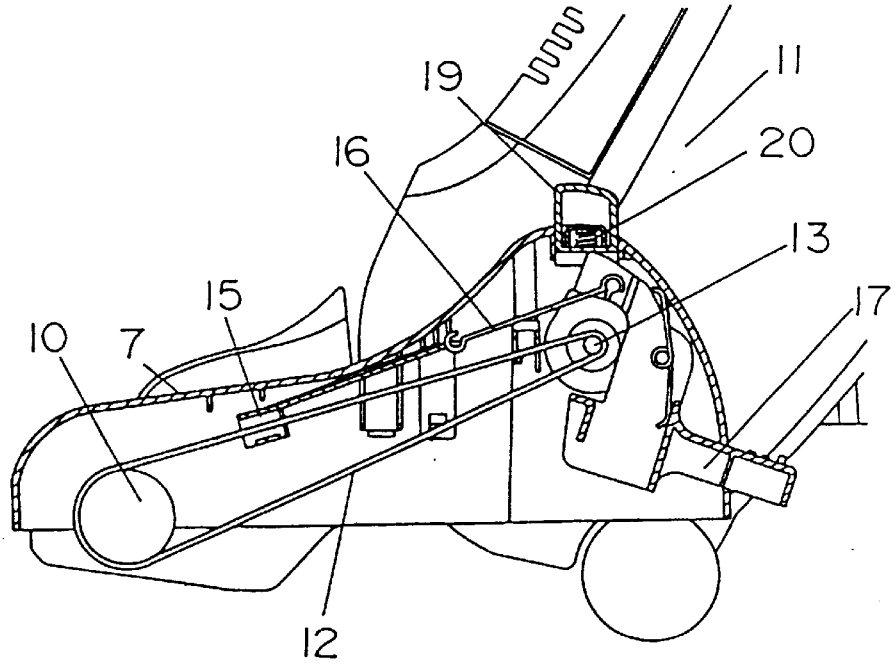
FIG. 10 is a vertical cross-sectional view showing the floor nozzle of FIG. 9 in a state when the pedal is pressed down.

Operation of the above structure is described in the following. As shown in FIG. 10, a pressing down of pedal 17 pushes the button 19 up, the button 19 having contact with the pedal 17 at the upper section. The popped-out button 19 may serve as an easy-to-see indicator that an agitator 10 is running and such convenience in using a vacuum cleaner may be promoted.

Further, as the button 19 is provided with downward tension by the button spring 20, the button 19 is assured to act reliably, without fear of being retarded in the middle of an action path, and a problem of the belt 12 switching due to uncertain action of button 19 may be prevented.

Then, when the once-popped-out button 19 is pushed down, a top part of pedal 17 is pressed, and a protrusion 17*a* (see FIG. 4), which has a spring property as a result of a cut 17*c* provided around the protrusion, is deformed and falls from the surface of cam 11*a* down onto stage 11*b*. The pedal 17 returns to the initial position and the rotation of agitator 10 is discontinued. Thus, the rotation of agitator 10 may be halted whenever an operator wishes, for instance, when sweeping a wooden floor where agitator 10 is not required to be running.

A fourth exemplary embodiment of the present invention is described in the following with reference to the drawings.

Figure 11:
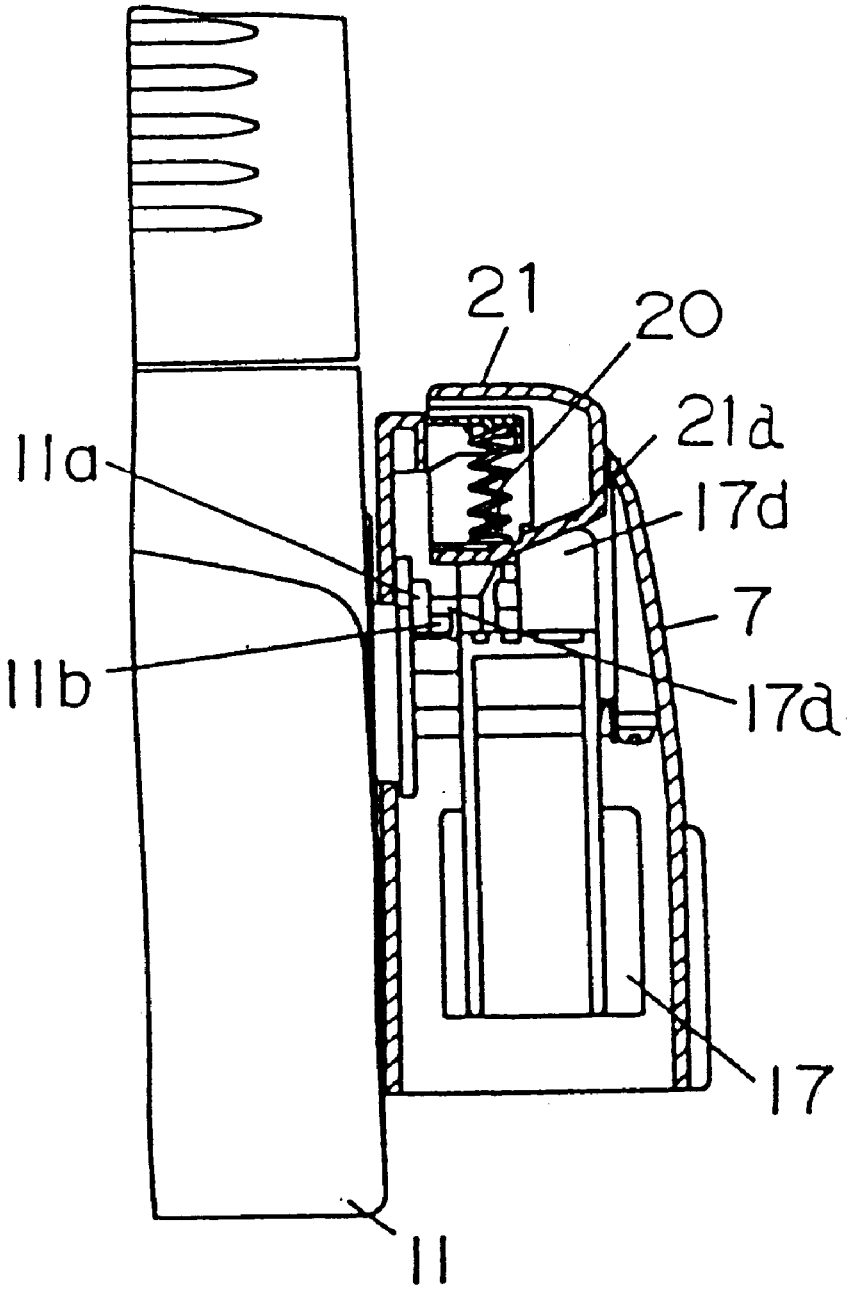
FIG. 11 is a vertical cross-sectional view showing a floor nozzle in accordance with a fourth embodiment of the invention.

As shown in FIG. 11, a button 21 is provided so that it can pop out and down freely through a hole located at a top section of floor nozzle 7, and is engaged with a motion of a pedal 17. The button 21 is provided with an inclination 21*a* at the bottom part while the pedal 17 is provided with an inclination 17*d* at the top part. When once-popped-out button 21 is pushed down, the pedal 17 slides in the thrusting direction (the direction right in FIG. 11), and then the pedal 17 is brought back to a position at which the tilt of handle sector 11 with respect to floor nozzle 17 is fixed, or the initial state. Other sections of the structure remain the same as those of the third embodiment.

Operation of the above structure is described in the following. When once-popped-out button 21 is pushed down, the pedal 17 is pressed at the top part and is shifted in the thrusting direction as a result of sliding between the inclination 17*d* and the inclination 21*a* of button 21. A protrusion 17*a* of pedal 17 falls off the cam 11*a* down onto stage 11*b*, pedal 17 returns to the initial position and the rotation of agitator 10 discontinues (see FIG. 5). Thus, the pedal 17 slides in the thrusting direction for exerting control over the agitator 10 without receiving much stress force. Consequently, the reliability of pedal 17 may be improved.

A fifth exemplary embodiment of the present invention is described in the following with reference to the drawings.

Figure 12:
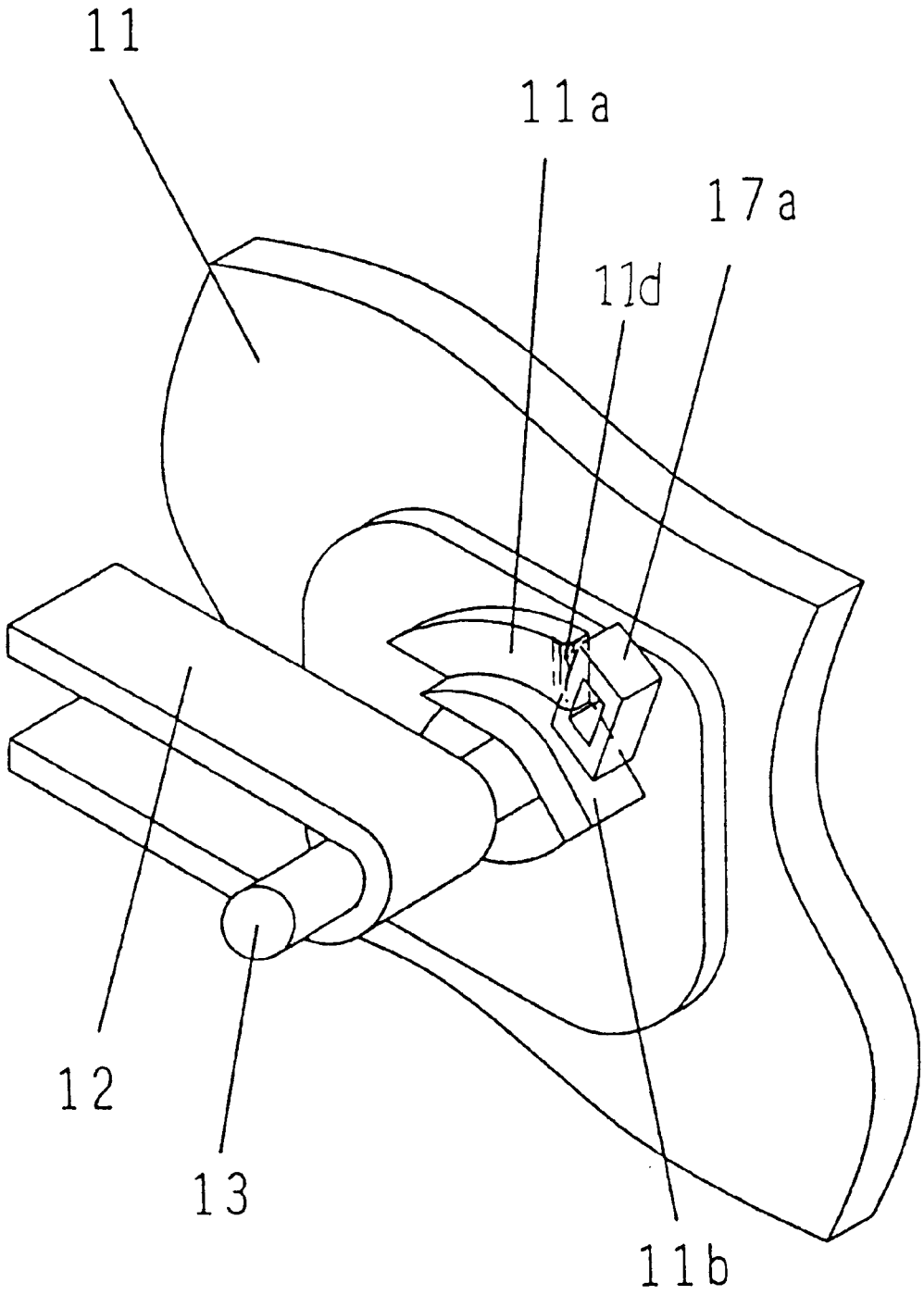
FIG. 12 is a perspective view of a key portion of a vacuum cleaner in accordance with a fifth exemplary embodiment of the invention.

As shown in FIG. 12, a corner lid of circular arc cam 11*a*, provided on a side of handle sector 11, is formed to have an arc shape of large radius so that a pedal 17 is not moved when handle sector 11 is forcibly tilted without the pedal 17 being pressed down. Other mechanisms remain the same as those of the above first exemplary embodiment.

Operation under the above structure is described in the following. When the handle sector 11 is forcibly tilted without the pedal 17 being pressed down, a protrusion 17*a* of the pedal 17 goes outside the cam 11*a* instead of riding on the outer circumferential surface of cam 11*a* because the corner 11*d* of cam 11*a*, provided on the side of handle sector 11, is shaped to form a circular arc of large radius, and the pedal 17 stays where it is. The above structure blocks moving of pedal 17 when handle sector 11 is forcibly tilted. Thus, security against abnormal use of a vacuum cleaner may be assured.

A sixth exemplary embodiment of the present invention is described in the following with reference to the drawings.

Figure 13:
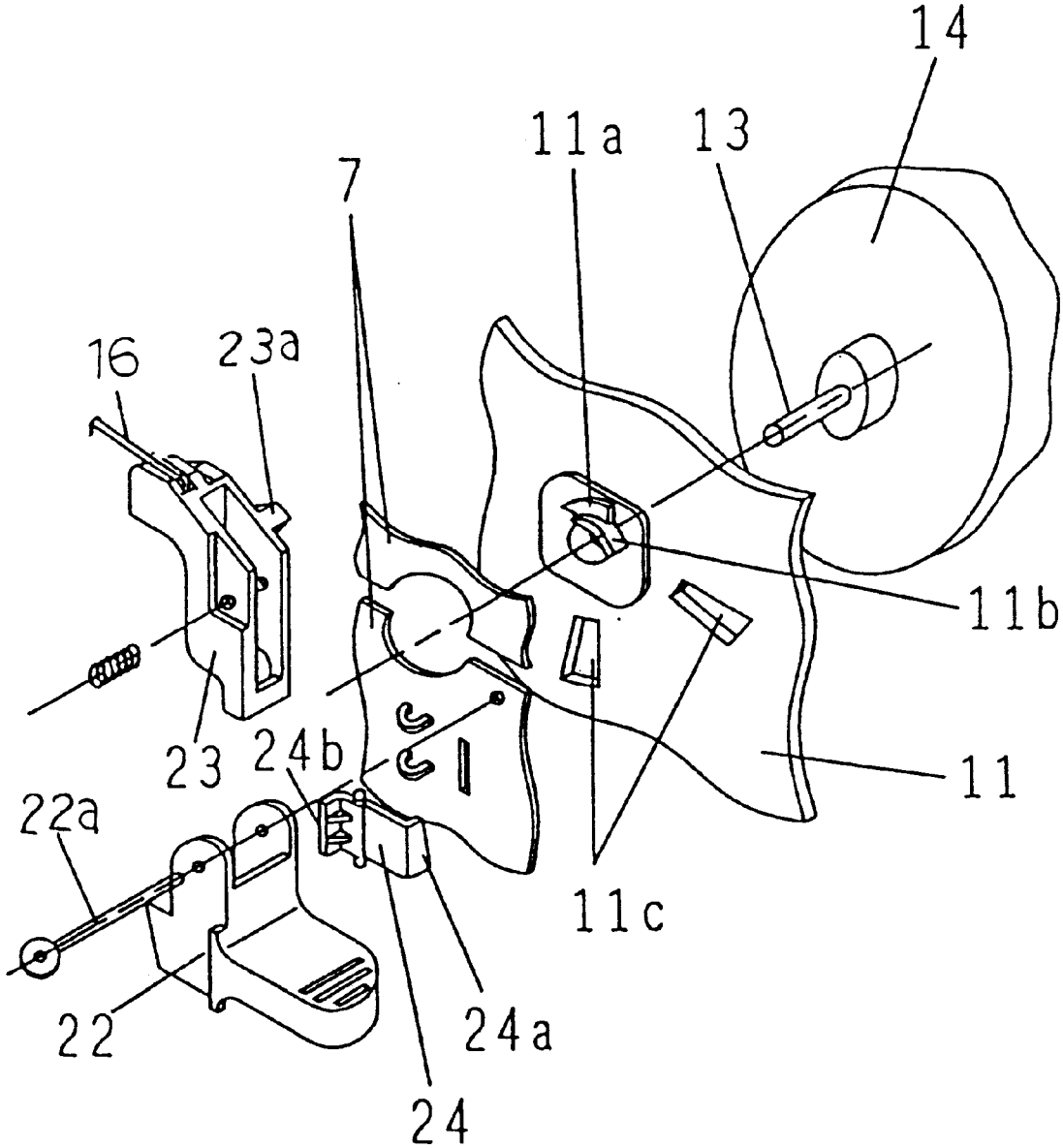
FIG. 13 is an exploded perspective view of a key portion of a vacuum cleaner in accordance with a sixth exemplary embodiment of the invention.
Figure 14:
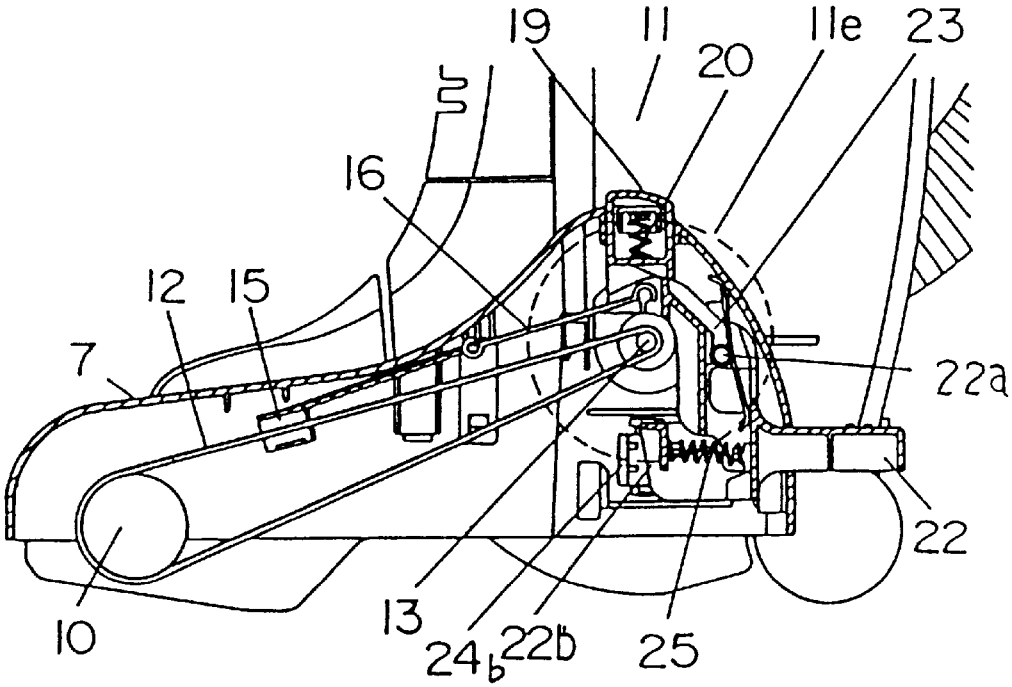
FIG. 14 is a vertical cross-sectional view of a floor nozzle of the vacuum cleaner of FIG. 13.
Figure 15:
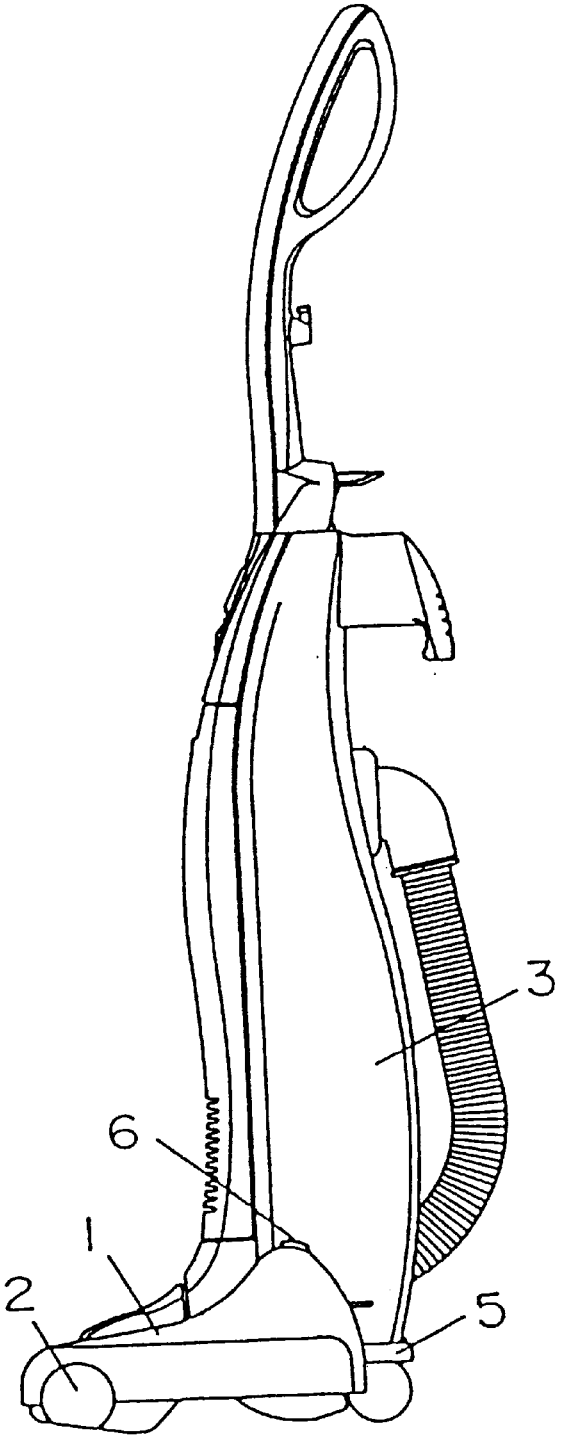
Fig. 15 PRIOR ART
FIG. 15 is a perspective view of a conventional vacuum cleaner.

In FIG. 13 and FIG. 14, a part of a first pedal 22 is exposed for operation from outside floor nozzle 7, and a second pedal 23 is provided engaged with the first pedal 22. The two pedals are fixedly rotatable, sharing a pin 22*a*. The second pedal 23 is provided with a protrusion 23*a* at a side and is connected to a connecting lever 16 at a top end for operating a switching lever 15, a button 19, etc. A latch 24 is for fixing/releasing the engagement between a handle sector 11 and a floor nozzle 7, and is fixedly rotatable on the floor nozzle 7. At a side of the handle sector 11, a linking section 11*c* is provided to accept insertion of the latch 24 for engaging the handle sector 11 with the floor nozzle 7. The latch 24 is driven by a rib 22*b* provided on the first pedal 22. A spring 25, provided for the first pedal, maintains the position of the first pedal at the initial state. Other sections of the structure remain the same as those of the above first exemplary embodiment.

Operation of the above structure is described in the following. When the first pedal 22 is left unpressed, it remains in the initial state, or a state as shown in FIG. 14, by virtue of the spring 25. In this state, the latch 24 is not being pressed at a pressing section 24*b* by the rib 22*b* of first pedal 22. Therefore, the protrusion 24*a* remains inserted in the linking section 11*c* provided at a side of handle sector 11, and the floor nozzle 7 and the handle sector 11 are fixedly engaged.

When the first pedal 22 is pressed down, the rib 22 of first pedal 22 pushes the latch 24 at pressing section 24*b* to withdraw the protrusion 24*a* within floor nozzle 7. As a result, the linkage between protrusion 24*a* and linking section 11*c* is freed. Thus, the engagement between handle sector 11 and floor nozzle 7 is released. At the same time, the second pedal 23 also moves in connection with the first pedal 22 to operate a switching lever 15, connected with the second pedal 23, for switching the positioning of belt 12. When the handle sector 11 is restored to the upright position, the protrusion 24 moves into the linking section 11*c* to fixedly engage the handle sector 11 and the floor nozzle. By providing a plurality of linking section 11*c* on a concentric circle, the handle sector 11 may be tilted and securely fixed at a plurality of tilting angles. This may significantly enhance convenience in using a vacuum cleaner.

As described in the foregoing passages, the rotation of an agitator may be started/halted by a single action of tilting a handle sector in the vacuum cleaner of the present invention, because the power for driving the agitator is transmitted or disconnected in accordance with tilting of the handle sector. Therefore, a vacuum cleaner may be presented in which, for example, the rotation of an agitator automatically stops when the handle sector is raised to an upright position. Such arrangement may eliminate possible damage to a carpet which could arise when a vacuum cleaner is left in a place with the handle sector standing while the agitator is kept rotating.

Further, because an agitator stops its rotation at least when the handle sector is positioned almost upright in the vacuum cleaner of the present invention, the agitator stops its rotation without fail whenever the vacuum cleaner is put on service with an attachment, or other service modes.

Furthermore, by constituting a power transmission device with a driving pulley fixed to an agitator, an idling pulley provided next to the driving pulley and freely rotatable from the motion of the agitator, and a belt, provided between a shaft of a fan motor and either the driving pulley or the idling pulley, which is switched by a switching lever to a position either on the driving pulley or on the idling pulley with the tilting action of a handle sector engaged to the switching lever, a vacuum cleaner may be presented with which the agitator starts its rotation when the handle sector is tilted and halts its rotation when the handle sector is restored to the upright position. Such vacuum cleaners may be assembled without substantially increasing the number of constituent components and the efficiency of assembly may also be improved.

Furthermore, by switching the orientation of a belt to an idling pulley with a switching lever when a handle sector is raised almost upright, and to a driving pulley when the handle sector is tilted down to a position other than upright, a vacuum cleaner may be presented with which an agitator automatically stops its rotation when the handle sector is raised upright for installing an attachment for example. Such a vacuum cleaner may not damage a floor material.

Furthermore, by engaging the action of a pedal with a switching lever, both tilting of a handle sector and starting of an agitator rotation may be made at a same time by a single action of pressing a pedal down. This may add an additional convenience in practical use of a vacuum cleaner.

Furthermore, by providing a spring device for always pulling a switching lever to a side at which a belt is orientated on an idling pulley, the belt is prevented from remaining in between the idling pulley and a driving pulley. This ensures a reliable switching action for the belt.

Furthermore, by providing a button which is engaged with pedal motion and pops out/down through a hole located in an upper section of floor nozzle, an operator can easily recognize that an agitator is in a rotating state. With such a constitution, a safety-oriented vacuum cleaner may be presented.

Furthermore, by providing a spring device for always pulling a button downward, the button is prevented from being retarded somewhere in the middle of the action path. This increases functional reliability of a vacuum cleaner.

Furthermore, by pushing down a once-popped-out button, a pedal is restored to a position that is the same position at which a tilted handle sector and a floor nozzle are fixedly engaged, or the initial state. This enables an operator to halt rotation of an agitator at any time, e.g., cleaning a wooden floor. Thus, an additional convenience and safety may be offered in a vacuum cleaner.

Furthermore, by making a pedal slide in the thrusting direction, with a push of a button, and then reach a position that is the same position at which a tilted handle sector and a floor nozzle are fixedly engaged, or the initial state, a force to be exerted on the pedal is reduced by the sidewise shift of the pedal. As a result, the reliability of the pedal, as well as convenience and safety in using a vacuum cleaner are improved.

Furthermore, by introducing a structure with which a pedal is not put to work when a handle sector is forcibly tilted with respect to floor nozzle without the pedal being pressed down, a switching lever does not function. Therefore an agitator does not rotate when a vacuum cleaner is used in a manner deviating from that described in a manual. Thus, safety in using a vacuum cleaner may be enhanced.

Furthermore, by forming a pedal with two pieces of component parts, namely, a first pedal to be pressed which is exposed outside of a floor nozzle and a second pedal, attached adjacent to the first pedal in the inside of the floor nozzle, for actuating a switching lever, and providing linking sections on a side of the handle sector and a latch on a surface of the floor nozzle for engaging the tilted handle sector and the floor nozzle by coupling of the linking section and the latch, by engaging the motion of the latch with the action of the first pedal, the latch action is controllable by pressing the first pedal and a surer engagement between the handle sector and the floor nozzle may be expected. Also, such engagement can be established easily at a plurality of angles. Thus, a vacuum cleaner having substantial advantages in handling convenience and other factors may be presented in accordance with the present invention.

I claim:

1. A vacuum cleaner comprising:

a floor nozzle housing an agitator configured to rotate and stir dust to be vacuumed;

a handle sector tiltably attached to said floor nozzle on a pivot in a rear section containing a fan motor for sucking dust and a dust bag for collecting dust; and a member having a first position for preventing the handle sector from tilting and a second position for enabling the handle sector to tilt;

wherein said member actuates a means for transmitting a driving force of said fan motor to said agitator when said member is in the second position.

2. The vacuum cleaner of claim 1, wherein rotation of said agitator is halted at least when said handle sector is positioned in a substantially upright position.

3. The vacuum cleaner of claim 1, wherein said means for transmitting a driving force comprises a driving pulley fixed to said agitator, an idling pulley disposed adjacent to said driving pulley rotating free from said agitator, a belt provided between a shaft of said fan motor and one of said driving pulley and idling pulley, and a switching lever for positioning said belt to one of said driving pulley and idling pulley, motion of said switching lever being controlled by the tilting movement of said handle sector.

4. The vacuum cleaner of claim 3, wherein said belt is positioned by said switching lever to said idling pulley when said handle sector is raised to said substantially upright position, and said belt is positioned by said switching lever to said driving pulley when said handle sector is tilted to a position other than said substantially upright position.

5. The vacuum cleaner of claim 3, said member comprising:

a pedal provided at a rear section of said floor nozzle, motion of said pedal being engaged with motion of said switching lever, said handle sector being fixed to said floor nozzle by using said pedal when said handle sector is positioned in said substantially upright position, and said handle sector being released from said floor nozzle by pressing said pedal to become freely tiltable.

6. The vacuum cleaner of claim 5, wherein said floor nozzle includes a hole located in an upper section and a button popping out/down freely through said hole, motion of said button being coupled to motion of said pedal.

7. The vacuum cleaner of claim 6, wherein said floor nozzle includes a bias for pulling said button downward.

8. The vacuum cleaner of claim 6, wherein pushing of said popped-out button returns said pedal to the first position.

9. The vacuum cleaner of claim 6, wherein said pedal slides by a push of said button to a thrusting direction and then returns to the first position.

10. The vacuum cleaner of claim 9, wherein said pedal does not function when said handle sector is forcibly tilted without said pedal being pressed down.

11. The vacuum cleaner of claim 5, wherein said pedal comprises a first pedal, at least a part of which is exposed outside said floor nozzle for operation outside said floor nozzle, and a second pedal attached to said first pedal for actuating said switching lever, said handle sector has a linking section on a side thereof, said floor nozzle has a latch on a surface thereof, motion of said latch being coupled to motion of said first pedal, and said handle sector and floor nozzle are fixed by coupling of said linking section and said latch.

12. The vacuum cleaner of claim 3, wherein said switching lever includes spring means for orientating said belt to said idling pulley.

13. A vacuum cleaner comprising:

a floor nozzle housing an agitator configured to rotate and stir dust to be vacuumed;

a handle sector attached to said floor nozzle on a pivot in a rear section containing a fan motor for sucking dust and a dust bag for collecting dust;

a member having a first position for preventing the handle sector from tilting and a second position for enabling the handle sector to tilt;

a driving pulley fixed to said agitator and configured to rotate the agitator;

an idling pulley disposed adjacent to said driving pulley rotating free from said agitator;

a belt provided between a shaft of said fan motor and one of said driving pulley and idling pulley; and a switching lever operatively connected to said member to position said belt to said idling pulley when the handle sector is in a substantially upright position and to position said belt to said driving pulley when said handle sector is tilted to a position other than said substantially upright position, said belt transferring a drive force of said fan motor to rotate the agitator when positoned over said driving pulley.

14. The vacuum cleaner of claim 13, said member comprising:

a pedal provided at a rear section of said floor nozzle, motion of said pedal being engaged with motion of said switching lever, said handle sector being fixed to said floor nozzle by using said pedal when said handle sector is positioned in said substantially upright position, and said handle sector being released from said floor nozzle by pressing said pedal to become freely tiltable.

15. The vacuum cleaner of claim 14, wherein said floor nozzle includes a hole located in an upper section and a button popping out/down freely through said hole, motion of said button being coupled to motion of said pedal.

16. The vacuum cleaner of claim 15, wherein said floor nozzle includes a bias for pulling said button downward.

17. The vacuum cleaner of claim 15, wherein pushing of said popped-out button returns said pedal to the first position.

18. The vacuum cleaner of claim 15, wherein said pedal slides by a push of said button to a thrusting direction and then returns to the first position.

19. The vacuum cleaner of claim 18, wherein said pedal does not function when said handle sector is forcibly tilted without said pedal being pressed down.

20. The vacuum cleaner of claim 14, wherein said pedal comprises a first pedal, at least a part of which is exposed outside said floor nozzle for operation outside said floor nozzle, and a second pedal attached to said first pedal for actuating said switching lever, said handle sector has a linking section on a side thereof, said floor nozzle has a latch on a surface thereof, motion of said latch being coupled to motion of said first pedal, and said handle sector and floor nozzle are fixed by coupling of said linking section and said latch.

21. The vacuum cleaner of claim 13, wherein said switching lever includes spring means for orientating said belt to said idling pulley.

22. A vacuum cleaner comprising:

a floor nozzle housing an agitator configured to rotate and stir dust to be vacuumed;

a handle sector tiltably attached to said floor nozzle on a pivot in a rear section containing a fan motor for sucking dust and a dust bag for collecting dust;

a member having a first position for preventing the handle sector from tilting and a second position for enabling the handle sector to tilt; and means for transmitting a driving force of said fan motor to said agitator when said handle sector is tilted from a substantially upright position, said means for transmitting a driving force comprises:

a driving pulley fixed to said agitator, an idling pulley disposed adjacent to said driving pully rotating free from said agitator, a belt provided between a shaft of said fan motor and one of said driving pulley and idling pulley, and a switching over for positioning said belt to one of said driving pulley and idling pulley, motion of said switching lever being controlled by a motion of the member, said switching )ever comprising a spring means.

23. A vacuum cleaner comprising:

a floor nozzle housing an agitator configured to rotate and stir dust to be vacuumed;

a handle sector attached to said floor noble on a pivot in a rear section containing a fan motor for sucking dust and a dust bag for collecting dust;

a driving pulley faded to said agitator and configured to rotate the agitator;

an idling pulley disposed adjacent to said driving pulley rotating fee from said agitator;

a belt provided between a shaft of said fan motor and one of said driving pulley and idling pulley; and a switching lever operatively connected to said handle section to position said belt to said idling pulley when the handle sector is in a substantially upright position and to position said belt to said driving pulley when said handle sector is tilted to a position other than said substantially upright position, said belt transferring a drive force of said fan motor to rotate the agitator when positioned over said driving pulley, said switching lever comprising a spring means for orientating said belt to said idling pulley.

* * * * *

UNITED STATES PATENT AND TRADEMARK OFFICE

CERTIFICATE OF CORRECTION

PATENT NO. : 6,044,520
DATED : April 4, 2000
INVENTOR(S) : Masafumi Yamamoto

It is certified that error appears in the above-identified patent and that said Letters Patent is hereby corrected as shown below:

Column 10,
Line 33, change “switching over for positioning” to -- switching lever for positioning --;
Line 36, change “switching )ever” to -- switching lever --;
Line 41, change “floor noble on a pivot” to -- floor nozzle on a pivot --;
Line 44, change “driving pulley faded to said” to -- driving pulley fixed to said --;
Line 47, change “rotating fee from said agitator” to -- rotating free from said agitator --.

Signed and Sealed this

Eleventh Day of May, 2004

JON W. DUDAS
*Acting Director of the United States Patent and Trademark Office*